US005714288A

United States Patent [19]

Vreeland, II et al.

[11] Patent Number: 5,714,288

[45] Date of Patent: *Feb. 3, 1998

[54] METHOD OF TRANSFERRING TONER TO A RECEIVER HAVING A SECTIONED SURFACE COATING

[75] Inventors: William B. Vreeland, II, Webster; Thomas N. Tombs, Brockport; Donald S. Rimai, Webster, all of N.Y.

[73] Assignee: Eastman Kodak Company, Rochester, N.Y.

[21] Appl. No.: 745,673

[22] Filed: Nov. 8, 1996

[ * ] Notice: The term of this patent shall not extend beyond the expiration date of Pat. No. 5,689,787.

[51] Int. Cl.[6] ..... G03G 13/01; G03G 13/16

[52] U.S. Cl. ..... 430/47; 430/126

[58] Field of Search ..... 430/47, 126

[56] References Cited

U.S. PATENT DOCUMENTS

| | | | |
|---|---|---|---|
| 4,737,433 | 4/1988 | Rimai et al. | 430/111 |
| 4,764,445 | 8/1988 | Miskinis et al. | 430/108 |
| 5,084,735 | 1/1992 | Rimai et al. . | |
| 5,156,915 | 10/1992 | Wilson et al. | 428/425.8 |
| 5,187,526 | 2/1993 | Zaretsky . | |
| 5,212,032 | 5/1993 | Wilson et al. | 430/65 |
| 5,217,838 | 6/1993 | Wilson et al. | 430/126 |
| 5,250,357 | 10/1993 | Wilson et al. | 428/425.8 |

OTHER PUBLICATIONS

R.M. Schaffert, "Transfer of Latent Electrostatic Images to Dielectric Surfaces*", Electrophotography, Foral Press, NY (1975), pp. 514–519.

Dessauer and Clark, Xerography and Related Processes, Focal Press, NY, p. 393.

N. Goel and P. Spencer, "Toner Particle–Photoreceptor Adhesion", Polym. Sci. Technol. 9B, (1975), pp. 763–827.

*Primary Examiner*—Roland Martin

*Attorney, Agent, or Firm*—Nelson Adrian Blish

[57] ABSTRACT

A particle toner image is formed on a primary image member (21), such as a photoconductor; electrostatically transferred to an intermediate transfer member (42); and then electrostatically transferred to a receiving sheet. The intermediate transfer member (42) includes a substrate, a compliant blanket (19), and a thin, hard overcoat (80) sectioned into small, discreet segments (81), said segments being separated cracks (85) having a width less than 20 μm

33 Claims, 5 Drawing Sheets

METHOD OF TRANSFERRING TONER TO A RECEIVER HAVING A SECTIONED SURFACE COATING

BACKGROUND OF THE INVENTION

1. Field of the Invention

This invention relates in general to the transfer of electrostatically formed toner images using an intermediate transfer member and in particular, to creation of multicolor toner images with small particle toners using an intermediate transfer member with a surface sectioned to enhance the transfer of the toner particles.

2. Description of the Prior Art

The use of an intermediate transfer member is useful in electrophotography for a number of reasons, including simplified receiving sheet handling, single pass duplexing, saving wear on photoconductors, and superposition of images to form multicolor images. Typically, a toner image is created on a photoconductive member electrophotographically and is then transferred to an intermediate transfer member, such as a roller or web. For example, a negatively charged toner image is transferred from a photoconductor having an electrically grounded backing electrode, to an intermediate web or roller biased to a strong positive polarity. The toner image is then transferred from the intermediate member to a receiving sheet under the influence of a second electric field. The second electric field can be created, without changing the voltage on the intermediate member, by placing a roller behind the receiving sheet, which is biased in a stronger, positive direction.

The most desirable use of intermediate transfer is for creating multicolor images. When an intermediate transfer member is used, two, three, four or more separate images of different color can be transferred in registration to the intermediate transfer member to create a multicolor image. The multicolor image can then be transferred in one step to the receiving sheet. This system has a number of advantages over the more conventional approach to making multicolor images in which the receiver sheet is secured to the periphery of a roller and rotated repeatedly into transfer relation with the photoconductor to receive the color images directly. The most important advantage is that the receiving sheet itself does not have to be attached to a roller. Attaching the receiving sheet to a roller has been a source of misregistration of images due to independently transferring each color image to the receiver, as well as complexity in apparatus. Other advantages, such as wear and tear on the photoconductive member and a straight and simple receiving sheet path are also important.

High resolution in electrophotographic color printing is desirable. In order to obtain higher resolution, fine toners are necessary. Toners less than 10 μm in size give substantially improved resolution in color imaging with high quality equipment. Unfortunately, fine toners are more difficult to transfer electrostatically than are traditional coarse toners. This is a problem using both single transfer and intermediate transfer members.

When transferring toners having a volume weighted average diameter less than 12 μm, and using electrostatics at both transfers, a number of transfer artifacts occur. For example, a well known artifact called "hollow character" is a result of insufficient transfer in the middle of high density toned areas, e.g., in alphanumerics. Another artifact, "halo" is experienced when toner fails to transfer next to a dense portion of an image. These problems cannot be eliminated merely by an increase of the transfer field, since that expedient is limited by electrical breakdown.

Another problem is that typical receivers have a surface roughness with surface irregularities having larger dimensions than the diameters of the small toner particles, as shown in FIG. 1. In some areas, particles 12 will be adjacent to peaks 13 in the roughness profile of the receiver 14 while others will be adjacent to valleys 15. When surface forces are balanced or nearly balanced, the applied electrostatic transfer force determines which surface the particle remains attached when the surfaces are subsequently separated. Particles near the receiver peaks will contact both surfaces and will transfer to the receiver presumably because of the balancing of surface forces. Particles adjacent to valleys in the receiver never contact the receiver and do not transfer because the surface forces are not balanced. In this case the electrostatic force on the small particles cannot be made large enough to overcome the surface forces holding the particles to the imaging surface because of the limitation imposed by electric field breakdown. See Schaffert, R. M., *Electrography*, Focal Press, New York, 1975, pp. 514–518.

Incomplete transfer can also be caused by toner particles having varying sizes. Larger toner particles, shown in FIG. 2, may contact both transfer surfaces while nearby smaller particles 17 do not. Larger particles, therefore, are preferentially transferred. (To simplify the description, both transfer surfaces shown are smooth in FIG. 2.) A similar problem occurs when stacks of large toner particles are adjacent to stacks of smaller toner particles. These effects are compounded by the previously described problem of rough receivers. Both effects contribute to a reduction in transfer efficiency and degradation in the granularity of the image, especially in areas with low toner densities.

Rimai and Chowdry have shown that by avoiding air gaps between toner and receiver, the surface forces can be at least partially balanced, thereby permitting images made using small toner particles to be transferred with high efficiency. See Rim and Chowdry, U.S. Pat. No. 4,737,433. See, also, Dessauer and Clark, *Xerography and Related Processes*, page 393, Focal Press (N.Y.), N. S. Goel, and P. R. Spencer, *Polym. Sci. Technol.* 9B, pp. 763–827 (1975).

Use of a simple compliant intermediate transfer member improves transfer efficiency compared to a non-compliant intermediate transfer member because it conforms to the variations in the roughness of the receivers and to any peaks caused by particulate contamination.

One attempt to solve the small toner transfer problem is disclosed in Rimai et al, U.S. Pat. No. 5,084,735 and Zaretsky, U.S. Pat. No. 5,187,526. These patents disclose the use of an intermediate transfer member with a compliant intermediate blanket with a thin overcoat, which has a higher Young's modulus than the underlying blanket. The blanket gives compliance, whereas the overcoat controls adhesion. At a transfer point, the compliant blanket, under pressure, conforms to the profile of a relatively rough receiver, which balances the surface forces, and the thin, hard overcoat improves the release properties of the toner. The overcoat is necessary because the compliant blanket is too "sticky" to allow the toner to be transferred to a receiver, usually paper, and particles become embedded in the soft material of the compliant blanket, thereby increasing the surface holding force. This adhesive force cannot be balanced by the surface forces attracting the particles to the receiver.

When a composite intermediate transfer member, comprised of a soft blanket with a hard overcoat, is in the form of a belt or drum, uncontrolled cracking and delamination of the hard, thin overcoat may occur. Cracking of the overcoat occurs because the hard overcoat cannot stretch when the intermediate transfer member is deformed by another contacting drum or roller. Such cracks in the overcoat introduce defects in the image.

One attempt to remedy this problem is disclosed in U.S. Ser. No. 08/648,846 in which the hard, thin overcoat is sectioned into small segments which remain bonded to the compliant blanket. The method and apparatus disclosed may be degraded if the space between the small segments is larger than the diameter of the toner particles. Also, the point at which toners are applied to and cleaned from the intermediate transfer member are important when the hard thin overcoat is sectioned into small segments because the small diameter toner particles may become lodged in the crack between the sections if the intermediate transfer belt is flexed at the time of transfer or cleaning.

SUMMARY OF THE INVENTION

It is the object of the invention to provide a method and apparatus for transferring toner images electrostatically from a first image member, to an intermediate transfer member, and then to a receiving sheet with a minimum of image defects and a maximum of toner transferred.

The above and other objects are accomplished by forming a toner image on a receiving sheet in which an electrostatic image is first formed on a primary image member. The electrostatic image is toned with a dry toner to form a toner image, and the toner image is transferred from the primary image member in the presence of an electric field urging toner particles from the primary image member to the intermediate transfer member. The toner image is then transferred from the intermediate transfer member to a receiving sheet in the presence of an electric field urging the toner particles from the intermediate transfer member to the receiving sheet.

The invention is characterized by an intermediate transfer member comprised of a substrate, a relatively thick compliant blanket of elastomeric material, and a hard, thin surface overcoat sectioned into segments. According to a preferred embodiment, the segments are formed by breaking the hard overcoat into discrete, small segments which remain bonded to the compliant blanket, and the space between the segments is less than the average weighted diameter of the toner particles. The invention enhances the micro-compliance of the intermediate transfer member without allowing a significant amount of toner particles to become trapped in the space between the segments.

DETAILED DESCRIPTION OF THE PREFERRED EMBODIMENT

Figure 1:
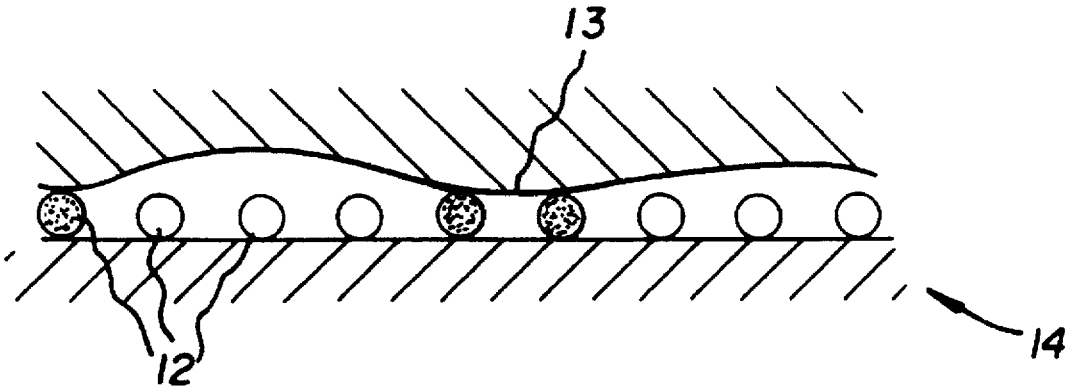
FIG. 1 PRIOR ART
FIG. 1 is cross-sectional view of a prior art intermediate transfer member and receiver showing surface irregularities on the receiver.
Figure 2:
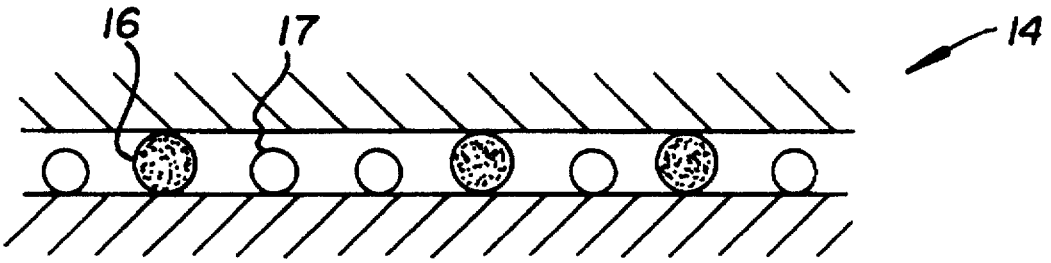
FIG. 2 PRIOR ART
FIG. 2 is a cross-sectional view of a prior art intermediate transfer member and receiver showing toner particles having a variety of sizes.
Figure 3:
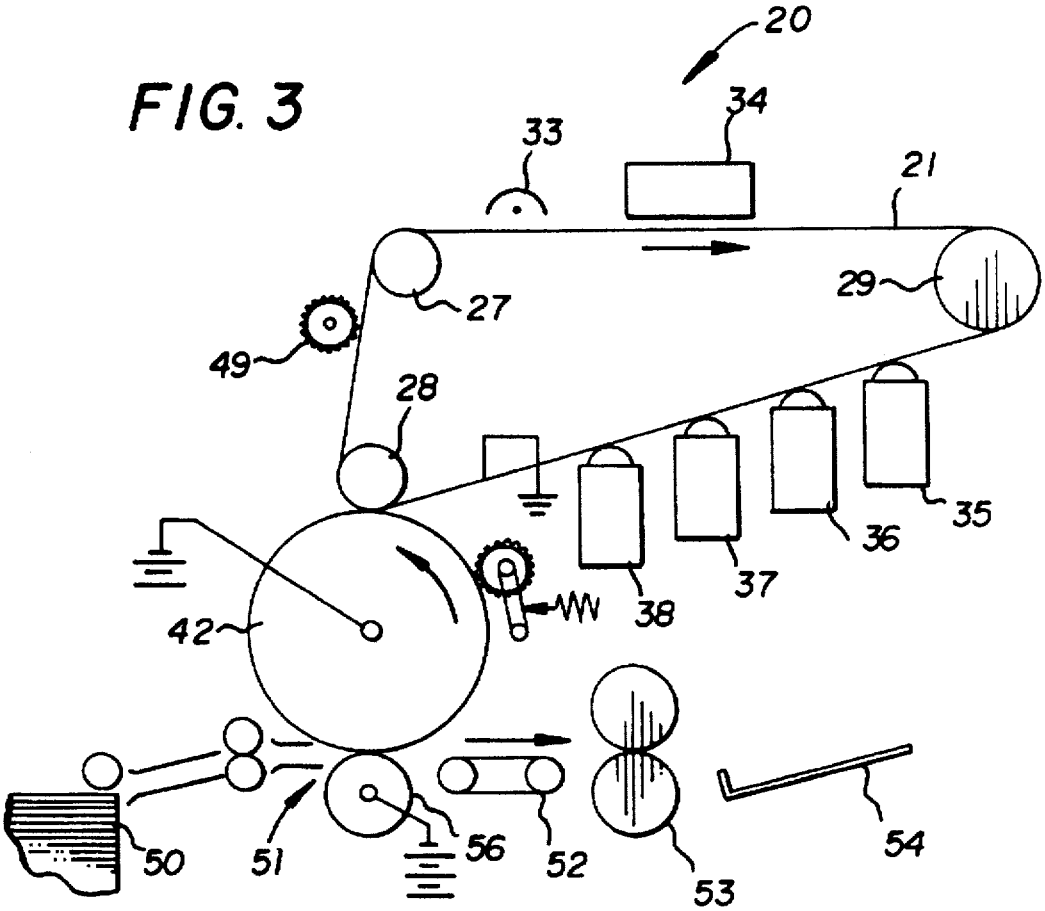
FIG. 3 is a schematic side view of a color printer apparatus utilizing the invention.

FIG. 3 illustrates an apparatus 20 in which the invention is intended to be used. A primary image member 21, for example, a photoconductive web, is trained about rollers 27, 28, and 29, one of which is drivable to move primary image member 21 past a series of stations well known in the electrophotographic art. Primary image member 21 is uniformly charged at a charging station 33, imagewise exposed at an exposure station 34 by means of, for example, an LED print head or laser electronic exposure station, to create an electrostatic latent image. The latent image is toned by one of toner stations 35, 36, 37, or 38 to create a toner image corresponding to the color of toner in the station used.

The toner image is transferred from primary image member 21 to an intermediate transfer member, for example, an intermediate transfer drum 42, at a transfer station formed with roller 28. Primary image member 21 is cleaned at a cleaning station 49 and reused to form more toner images of different colors, utilizing toner stations 35, 36, 37, and 38. One or more additional images are transferred in registration with the first image transferred to intermediate transfer drum 42, to create a single or multicolor toner image on the surface of transfer intermediate transfer drum 42.

The single or multicolor image is transferred to a receiving sheet which has been fed from supply 50 into transfer relationship with intermediate transfer intermediate transfer drum 42 at transfer station 51. The receiving sheet is transported from transfer station 51 by a transport mechanism 52 to a fuser 53 where the toner image is fixed by conventional means. The receiving sheet is then conveyed from the fuser 53 to an output tray 54.

The toner images are transferred from the primary image member 21 to the intermediate transfer intermediate transfer drum 42 in response to an electric field applied between the core of intermediate transfer drum 42 and a conductive electrode forming a part of primary image member 21. The multicolor toner image is transferred to the receiving sheet at transfer station 51 in response to an electric field created between a backing roller 56 and transfer intermediate transfer drum 42. Thus, intermediate transfer drum 42 helps establish both electric fields. As is known in the art, a polyurethane roller containing an appropriate amount of anti-static material to impart some conductivity can be used for establishing both fields. Typically, the electrode buried in primary image member 21 is grounded for convenience in cooperating with the other stations in forming the electrostatic and toner images. If the toner is a positively-charged toner, an electrical bias applied to intermediate transfer intermediate transfer drum 42 of typically −200 to −1500 volts will effect substantial transfer of toner images to intermediate transfer drum 42. To transfer the toner image onto a receiving sheet at transfer station 51, a bias of about −3000 volts, is applied to backing roller 56 to again urge the positively charged toner to transfer to the receiving sheet. Schemes are also known in the art for changing the bias on intermediate transfer drum 42 between the two transfer locations so that the bias of roller 56 need not be at such a high potential.

Figure 4:
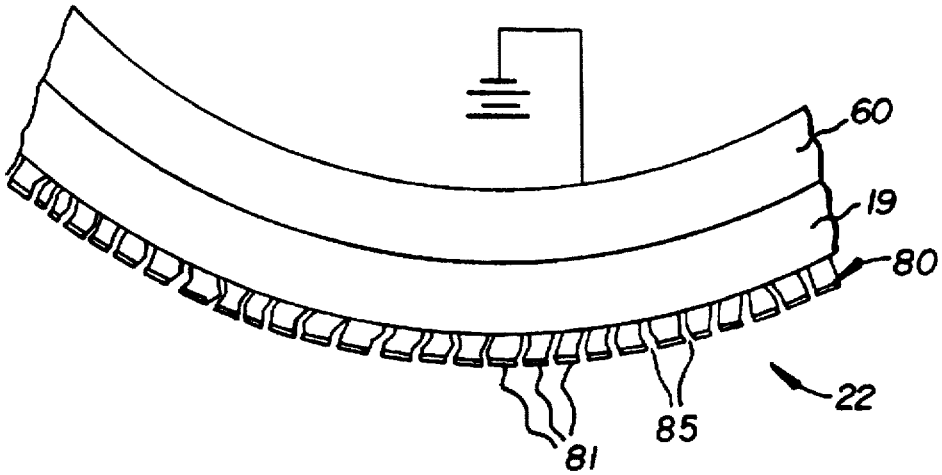
FIG. 4 is a cross-section of a portion of an intermediate transfer drum constructed according to the invention.

A partial cross-section of a preferred embodiment of a transfer intermediate member is shown in FIG. 4 in which the intermediate transfer drum 42 has a compliant blanket 19, comprised of an elastomeric material such as polyurethane. The compliant blanket 19 has a thickness of greater than 0.1 mm and the thickness is preferably in the range of 2 mm to 30 mm. The compliant blanket 19, supported by a drum 60 is fabricated of a rigid material such as aluminum.

The compliant blanket 19 must be flexible enough to conform to the irregularities encountered in electrostatic toner transfer. This is accomplished by using an elastomeric material that has a Young's modulus of between 0.5 MPa. (MegaPascals) and 10 MPa. Preferably, the Young's modulus of the compliant blanket should lie between 1.0 MPa. and 5 MPa.

The compliant blanket of the intermediate transfer member typically would not be insulative so that an electric field could be applied to cause transfer. The optimum resistivity of the elastomeric blanket is affected by the thickness of the intermediate transfer member, the speed of the process, and the geometry of the transfer system. The elastomeric material should have an electrical resistivity between about $10^6$ ohm-cm and about $10^{12}$ ohm-cm, and preferably between about $10^8$ and about $10^{10}$ ohm-cm. Examples of suitable materials for the compliant blanket include but are not limited to: polyurethane, silicone rubber, and silicone foam.

A hard, sectioned overcoat having a Young's modulus $\geqq 0.1$ GPa, 80 is formed on top of the compliant blanket 19. Increased compliance of the intermediate transfer member is achieved, without affecting the release properties of the overcoat, by sectioning the hard, thin overcoat in a controlled manner, creating cracks which extend through the overcoat. Cracks 85 penetrate the overcoat 80 from a top surface to compliant blanket 19. The average width of the cracks 85 should be less than 20 μm on a flat portion of the intermediate, preferably, having an average crack width less than 12 μm, and more preferably less than 6 μm. The crack width refers to the unstretched intermediate and can be measured using standard techniques such as a atomic force microscopy, optical microscopy or scanning electron microscopy.

Figure 5:
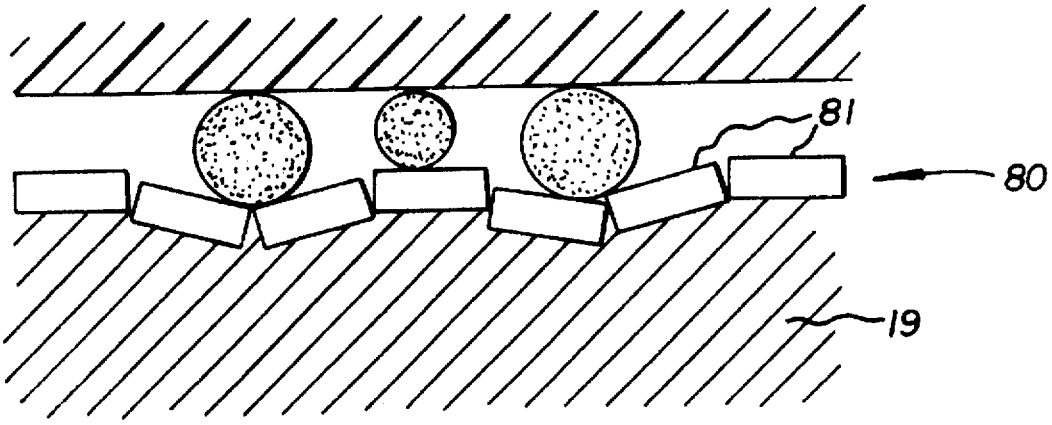
FIG. 5 is a cross-section of a portion of an intermediate transfer member in the form of a web according to an alternate embodiment of the invention.
Figure 6A:
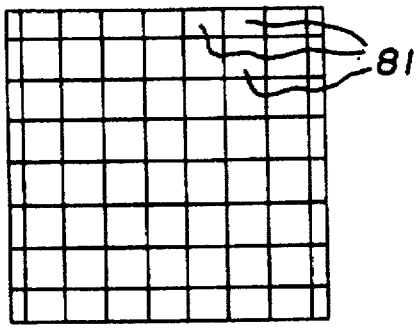
FIGS. 6(*a*)–6(*d*) are top plan views of sectioned overcoats on an intermediate member according to the present invention.
Figure 6B:
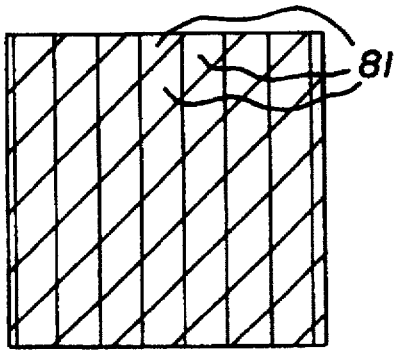
Figure 6C:
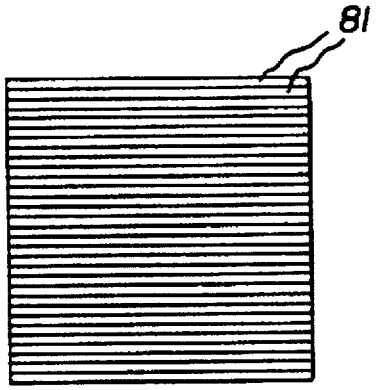
Figure 6D:
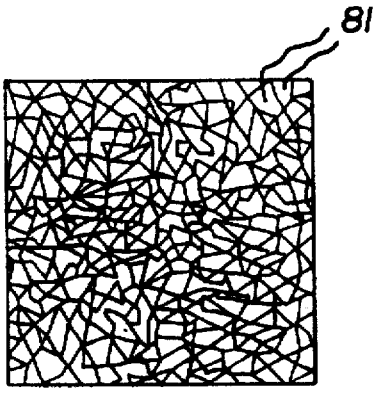

The segments 81 are free to move somewhat independently of the surrounding sections as shown in more detail FIG. 5. This independence of movement enhances the micro-compliance of the intermediate transfer member when compared to an intermediate transfer member having a continuous overcoat.

The sectioned overcoat can be formed on the intermediate transfer member in many different ways, all of which enhance micro-compliance. Examples of methods of sectioning the overcoat include etching, either chemically, with laser, or other radiation; cracking the layer in a controlled manner with mechanical means, such as bead-blasting, rolling the surface across a dimpled surface or, in the case of a belt, simply running the belt over a roller of small diameter, and under tension; or by selection of an appropriate solvent in cases where the overcoat is a thermoplastic. To achieve cracking by the mechanical method recited, the ratio of the thickness of the intermediate transfer member to the diameter of the roller should be greater than 0.1 and, preferably, greater than 0.2. The tension on the web belt is not critical.

The shape of the segments 81 of the overcoat are not critical and can be regularly shaped, e.g., square, hexagonal, or rectangular, as shown in FIGS. 6(*a*) and 6(*b*), or they can be irregular, as shown in FIG. 6(*d*). Long, thin segments would also be acceptable as shown in FIG. 6(*c*). It is preferred that the longest dimension of each segment be less than 3 mm, regardless of the shape. For very high quality imaging, even smaller segments are preferred, wherein the largest dimension of any segment is less than 0.3 mm so that any resultant sectioning of the final image is not perceptible by the human eye.

The thickness of the sectioned overcoat should be between 0.1 and 30 μm and preferably between 1 and 10 μm. Many materials are suitable for the overcoat and examples include but are not limited to: polyurethane, and diamond-like carbon. The Young's modulus of the sectioned overcoat should be significantly larger than the underlying blanket and is preferably greater than 0.1 GPa=100 MPa. The electrical resistivity of the sectioned overcoat is not an important consideration when the overcoat is very thin. However, it is preferred that the resistivity be in the range of $10^7$ ohm-cm and $10^{13}$ ohm-cm.

The overcoat should be strongly bonded to the compliant blanket to preclude delamination. A preferred method is to coat layers of the polymer overcoat material on the compliant blanket so that the polymer chains of the layers are interpenetrating. Sol-gel technology may be used to deposit the overcoat on the compliant blanket. Sol-gel refers to material that is actually gelatinous when applied, but a solid when cured. Alternatively, other methods, such as chemical bonding and the use of adhesion promoters or adhesives, could be used.

Figure 7:
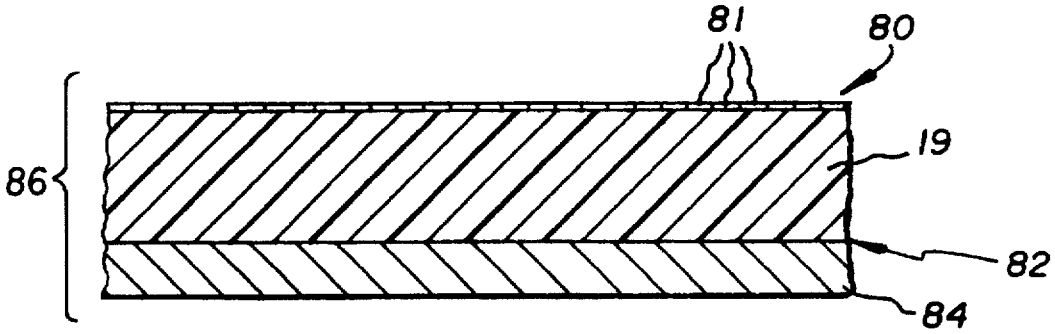
FIG. 7 is a cross-sectional view of an intermediate transfer member according to the present invention.

The multilayer structure comprised of compliant blanket and overcoat, described above, must reside on a supporting layer, such as a drum or a web. When employing an electrostatic transfer means, the support should be sufficiently conductive so that a voltage applied to it affects transfer of the toned image. In an alternative embodiment, a conducting layer 82 is isolated between the supporting layer and the compliant blanket, as shown in FIG. 7. The transfer bias would then be applied to the conducting layer.

The intermediate transfer member structure described is suitable for use as a drum or a web belt. The intermediate transfer member, when it takes the form of a web belt 86 shown in FIG. 7, can be made to traverse an irregular path. For use as a web belt, the intermediate transfer member consists of a compliant blanket 19 and an overcoat 80 with the properties described above, optional conducting layer 82, and backing member 84. It is preferred, however, to incorporate backing member 84 adjacent to the compliant blanket 19.

Backing member 84 consists of a flexible material having a Young's modulus greater than 1 GPa (GigaPascal) and serves as a support for the elastomeric blanket 19. When used without conducting layer 82, this material should be sufficiently conductive so as to allow the intermediate transfer member to be electrically biased. In this embodiment, the transfer bias can be applied using techniques such as incorporating electrically biased, conducting back-up rollers in the transfer nips. Suitable backing member materials include nickel and stainless steel, which can be made sufficiently thin so as to allow them to flex around any rollers and angles encountered in the path of the web. Alternatively, polymers or other materials having suitable Young's modulus and flexibility are also acceptable. If the material used for the backing member is electrically insulating, it should be coated with an electrically conductive layer such as evaporated nickel on the side contacting the compliant blanket. It is preferable, however, to use a semi-conducting support, such as a polymeric material, having a sufficiently high Young's modulus, doped with a charge transport material, such as those described in U.S. Pat. Nos. 5,212,032; 5,156, 915; 5,217,838; and 5,250,357. This allows the voltage applied to the web to be varied spatially.

When using the intermediate transfer member structure defined here, the problem of image defects is minimized. The sectioning of the overcoat allows the outer surface of the intermediate transfer member to stretch when it travels over rollers because the coating is essentially comprised of separate segments which are free to move independently.

The average crack width between segments is important. A hard, sectioned overcoat having a Young's modulus ≧0.1 GPa, 80 is formed on top of the compliant blanket 19. Increased compliance of the intermediate transfer member is achieved, without affecting the release properties of the overcoat, by sectioning the hard, thin overcoat in a controlled manner, creating cracks which extend through the overcoat. Cracks 85 penetrate the overcoat 80 from a top surface to compliant blanket 19. The average width of the cracks 85 should be less 20 μm on a flat portion of the intermediate, preferably, having an average crack width less than 12 μm, and more preferably less than 6 μm. The crack width refers to the unstretched intermediate and can be measured using standard techniques such as a atomic force microscopy, optical microscopy or scanning electron microscopy.

Figure 8:
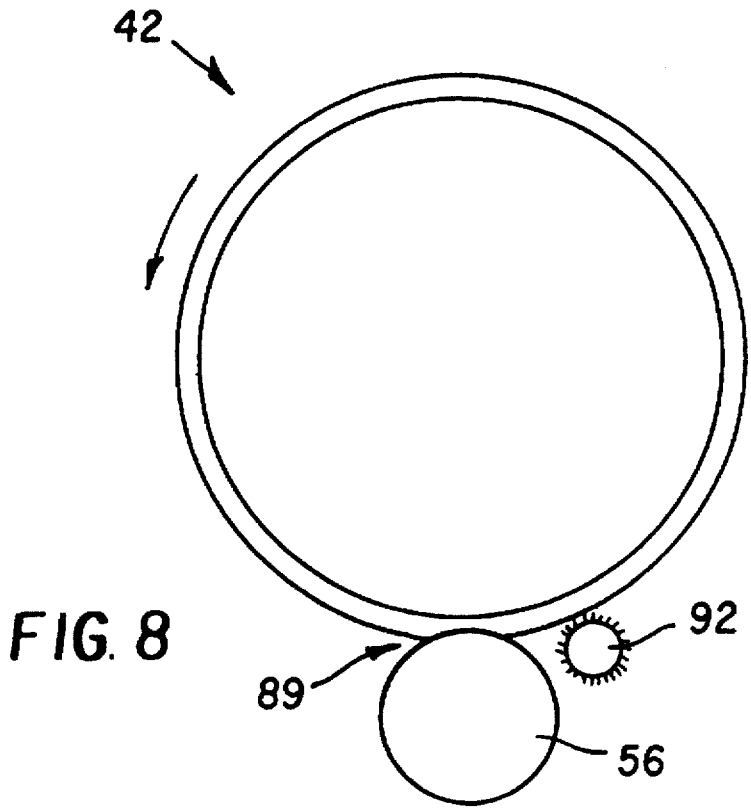
FIG. 8 is a cross-sectional view of an intermediate transfer roller according to the present invention.

As shown in FIG. 8, when the intermediate transfer member is in the form of an intermediate transfer drum, the crack width typically varies during transfer of the toner from the photoconductor to the intermediate transfer member, or from the intermediate transfer member to a receiver, because the intermediate transfer member is compressed.

Figure 9:
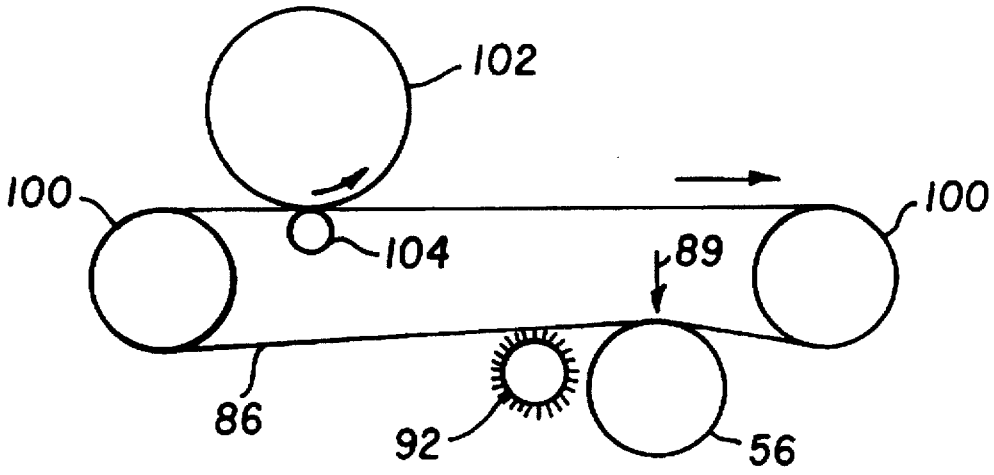
FIG. 9 is a cross-sectional view of an alternate embodiment of an intermediate transfer web according to the present invention.

When the intermediate transfer member is in the form of a web, however, the crack width increases when the web traverses supporting rollers 100, as shown in FIG. 9. To prevent the toner from lodging in the cracks under this circumstance, cleaning of the intermediate transfer member should take place only when the web is flexed in a manner that reduces the crack width thus cleaning roller 92 should be placed as close as practical to backing roller 56 while the web 86 is flexed in the direction shown which tends to close the cracks between the segments 81. Placing cleaning roller adjacent to either of the support rollers 100 should be avoided since web 86 flexes in the direction which would tend to widen the cracks between the segments 81.

In a similar manner the toned image should be transferred to the intermediate transfer member 86 at a location where the sectioned overcoat is not flexed in a manner which would separate the segments 81 as shown in FIG. 9 and a photoconductor drum 102 is used with a soft back up roller 104 to transfer the toned image to intermediate transfer member 86 at a location where the sectioned overcoat 80 is not flexed by transfer rollers 100.

EXAMPLE 1

An intermediate transfer system which included a photoconductive element, a roller and a backup roller was constructed according to the present invention. The photoconductive element was an organic photoconductor such as those found in the Kodak 2100 copier duplicator.

The intermediate transfer member consisted of a compliant blanket and a sectioned overcoat over an aluminum core. The compliant blanket was 5.1 mm thick and was composed of polyurethane doped with an antistatic material to yield a resistivity of $10^9$ ohm-cm. The Young's modulus of the compliant blanket was 2 MPa. The overcoat was a urethane resin sold under the trade name Permuthane® by Stahl Finish. The thickness of the overcoat was 12 μm, the Young's modulus was 320 MPa, and the resistivity was $10^{12}$ ohm-cm. The diameter of the intermediate transfer member was 146 mm.

The intermediate transfer member was prepared as follows. TU-400 is a commercially available two part polyurethane system from Conap, Inc., Olean, N.Y. TU-400 Part A is a polyisocyanate resin, and TU-400 Part B is a hardening agent consisting primarily of a chain extender and a catalyst. An antistat comprising a complex of one mole sodium iodide with three moles diethylene glycol was prepared. To a three liter glass kettle containing 7.876 grams antistat, 1041.240 grams TU-400 part B were added. The mixture was mechanically stirred for three minutes at room temperature. Then 1601.18 grams of TU-400 Part A were added to the kettle and the reaction was mixed under nitrogen for five minutes. The incorporated nitrogen was removed under reduced pressure (0.1 mm Hg) and the mixture was poured into a prepared mold with a roller core in the middle. The polyurethane was cured at 80° C. for sixteen hours. After eighteen hours, the roller was removed from the mold and ground to 14.6 cm in diameter. The roller was then overcoated with 12 μm layer of Permuthane U6729.

The irregular segments on the overcoat were made by rolling a hard, small diameter roller across the overcoat at high pressure. The resulting segments formed in the overcoat had dimensions ranging from about 0.1 mm to 0.5 mm and the average width of the cracks between the segments was approximately 6.8 μm. To achieve transfer from the intermediate transfer member to the receiver, the receiver was passed through nip formed by the intermediate transfer member and a backing roller. The backing roller consisted of a steel core, with a layer of polyurethane doped with antistat to achieve a resistivity of $2\times10^9$ ohm-cm. The thickness of the polyurethane layer on the backing roller was 5.1 mm and the Young's modulus was 40 MPa. The diameter of the backing roller was 37 mm.

The marking toner was comprised of a 3.5 micron, volume weighted diameter dry toner made by the limited coalescence process (silica stabilized). The binder was Piccotoner® 1221 binder, a styrene butylacrylate copolymer (80/20), available from Hercules Sanyo Inc. The pigment was bridged aluminum phthalocyanine, 12.5% by weight of the toner. The charge agent was tetradecylperidinium tetraphenyl borate, 0.4% by weight of the toner. The charge to mass ratio of the toner was 62 μC/g (micro Coulombs per gram) and the toner concentration of the developer was 6% by weight of the developer. The marking toner had 0.1 μm diameter silica particles, adhering to its surface, comprising 0.5% by weight based on the weight of the toner particles. The brand of these particles is T604, available from DeGussa Corp. The silica particles were dry blended using a Hobart mixer with the toner particles to achieve a uniform distribution of adhered or embedded or both, transfer assisting particles on the toner particles. Materials suitable for transfer assisting addenda particles include titanium dioxide and magnetite. An acceptable range for the diameter of the transfer assisting addenda particles is 0.03 to 0.2 μm. The carrier was a lanthanum doped, hard ferrite core coated with a 1:1 blend of a polyvinylidene fluoride, Kynar 301F (Penwalt Corp.) and polymethylmethacrylate made as described in U.S. Pat. No. 4,764,445.

The method of depositing the toner onto the photoconductor was the same as the process used in the Kodak ColorEdge copier duplicator, a product previously manufactured by the Eastman Kodak Company.

The marking toner was developed on a single frame of the photoconductor to yield a toner scale or patches having a range of image densities. The marking toner frame was then transferred to the intermediate transfer member by applying −700V to the core of the intermediate transfer member. The patches were then transferred to a clay coated paper, Krome Kote®, produced by Champion, Inc. in the transfer nip formed by the intermediate transfer member and the backing roller by applying a potential difference of 2300V between the intermediate transfer member and the backup roller.

The sectioned overcoat introduced no defects or image degradation in the print, and excellent transfer efficiency was demonstrated.

EXAMPLE 2

Example 2 used the same process and parameters as in Example 1 except that a different intermediate transfer member and different marking toner were used. The intermediate transfer member was a roller consisting of a compliant blanket layer and an overcoat. The compliant blanket consisted of polyurethane material doped with antistatic material having a resistivity of $4\times10^8$ ohms-cm, a thickness of 5.1 mm, and a Young's modulus of 3.8 MPa. The overcoat consisted of a 12 mm thick layer of Permuthane® available from Stahl Finish.

The intermediate transfer member was prepared as follows. L42 is a polyisocyanate resin available from Uniroyal. EC-300 is an amine chain extender available from Ethyl corporation. An antistat complex comprising one mole ferric chloride and three moles diethylene glycol, was added to a three liter glass beaker containing 0.437 grams tetraethylene glycol, and the mixture was stirred for five minutes. Then 846.76 grams of L42 resin were added and the reaction was stirred for two minutes. Then 9.53 grams of EC-300 were added, and the reaction was stirred for five minutes. Then the air was removed under reduced pressure (0.10 mm Hg). The resulting mixture, which is a type of polyurethane, was poured into a prepared mold with a roller core in the middle and was cured at 80° C. for eighteen hours. The roller was removed from the mold and ground to a diameter of 14.6 cm. The roller was then overcoated with a 12 micron layer of Permuthane U6729.

The sectioned overcoat was formed as in Example 1. The harder blanket resulted in smaller segments which averaged about 0.3 mm in length and 0.1 mm and the average width of the crack between the segments is approximately less than 10 μm. The sectioned overcoat introduced no defects in the final print and excellent transfer efficiency was demonstrated. The marking toner was the same as in Example 1 except that it had no silica transfer assisting addenda. An acceptable range for the diameter of the transfer assisting addenda particles is 0.03 to 0.2 μm.

The invention has been described in detail with particular reference to preferred embodiment thereof, but it will be understood that variations and modifications can be effected within the spirit and scope of the invention as set forth in the claims.

For example, it's expected that toner particles will have a volume weighted average diameter between 1 and 10 microns and preferably between about 3 to 8 microns.

PARTS LIST

| | |
|---|---|
| 12. Toner particles | 81. Segments |
| 13. Peaks | 82. Conducting layer |
| 14. Receiver | 84. Backing member |

-continued

PARTS LIST

| | |
|---|---|
| 15. Valleys | 85. Cracks |
| 16. Large Particles | 86. Web |
| 17. Small particles | 92. Cleaning roller |
| 18. Overcoat | 100. Support roller |
| 19. Compliant blanket | 102. Photoconductor drum |
| 20. Apparatus | 104. Soft back up roller |
| 21. Primary Image member or Photoconductive web | |
| 27. Roller | |
| 28. Roller | |
| 29. Roller | |
| 33. Charging station | |
| 34. Exposure station | |
| 35. Toner station | |
| 36. Toner station | |
| 37. Toner station | |
| 38. Toner station | |
| 42. Intermediate transfer drum | |
| 49. Cleaning station | |
| 50. Supply | |
| 51. Transfer station | |
| 52. Transport mechanism | |
| 53. Fuser | |
| 54. Output tray | |
| 56. Backing roller | |
| 60. Intermediate transfer drum | |
| 80. Sectioned overcoat | |

We claim:

1. A method of forming a toner image on a receiver, said method comprising:

forming an electrostatic latent image on a primary image member;

toning said latent image with a dry toner, comprised of toner particles, to form said toner image by applying said dry toner to said electrostatic image;

transferring said toner image from said primary image member to an intermediate transfer member in the presence of an electric field urging toner particles from said primary image member to said intermediate transfer member, wherein said intermediate transfer member is comprised of an overcoat of hard material and a compliant blanket, wherein said overcoat is sectioned into segments and said segments are on average separated by less 20 μm; and transferring said toner image from said intermediate transfer member to a receiving sheet in the presence of an electric field urging said toner particles from said intermediate transfer member to said receiving sheet.

2. The method according to claim 1 wherein said segments are separated by less than approximately 12 μm.

3. The method according to claim 1 wherein said segments are separated by less than 6 μm.

4. The method according to claim 1 wherein said segments are less than approximately 0.3 mm in length.

5. The method according to claim 1 further comprising the steps of:

removing excess toner particles from said intermediate transfer member after said toner image has been transferred to said receiver and while a top surface of said intermediate transfer member is flexed in a direction which urges said segments together.

6. The method according to claim 1 wherein said toned image is transferred from said primary image member to said intermediate transfer member wherein a top surface of said intermediate transfer member is flexed in a direction which urges said segments together.

7. The method according to claim 1 wherein said segments are less than approximately 3 mm in length.

8. The method according to claim 7 wherein said compliant blanket is an elastomeric material.

9. The method according to claim 8 wherein said elastomeric material has an electrical resistivity between $10^6$ ohm-cm and $10^{12}$ ohm-cm.

10. The method according to claim 8 wherein said elastomeric material has an electrical resistivity between $10^8$ ohm-cm and $10^{10}$ ohm-cm .

11. The method according to claim 8 wherein said elastomeric material is between 0.1 mm and 30 mm thick.

12. The method according to claim 8 wherein said elastomeric material is a polyurethane layer.

13. The method according to claim 7 wherein said toner particles have a volume weighted average diameter between about 1 and about 10 μm.

14. The method according to claim 13 wherein said toner particles have a volume weighted average diameter between about 3.0 and about 8.0 μm.

15. The method according to claim 7 wherein said toner particles have silica particles on a surface of the toner particles.

16. The method according to claim 7 further comprising the step of forming said segments by etching.

17. A method according to claim 7 further comprising the step of forming said segments by a laser.

18. A method according to claim 7 further comprising the step of forming said segments by cracking said layer in a controlled manner.

19. A method according to claim 7 further comprising the step of forming said segments by cracking said layer by bending said layer over a roller.

20. A method according to claim 7 further comprising the step of forming said segments by bead blasting said overcoat.

21. A method according to claim 7 further comprising the step of forming said segments is formed by rolling said overcoat across a dimpled surface.

22. The method according to claim 7 wherein said segments are squares.

23. The method according to claim 7 wherein said segments are hexagons.

24. The method according to claim 7 wherein said segments are irregular in shape.

25. The method according to claim 7 wherein said intermediate transfer member is a web.

26. The method according to claim 7 wherein said intermediate transfer member is a roller.

27. The method according to claim 7 wherein said overcoat has a thickness between 0.1 and 30 μm.

28. The method according to claim 7 wherein said overcoat has a thickness in the range of approximately 1 to 10 μm.

29. The method according to claim 7 wherein said overcoat has a Young's modulus of greater than approximately 0.1 GPa.

30. A method of forming a multicolor toner image on a receiving sheet, said method comprising:

forming a series of electrostatic images on a primary image member;

toning said electrostatic images with different color dry toner particles to form a series of different color toner images;

transferring said different color toner images from said primary image member to an intermediate transfer member, in the presence of an electric field urging toner particles from said primary image member to said intermediate transfer member, in registration, to form a multicolor image on the intermediate transfer member, wherein the intermediate transfer member is comprised of an overcoat and a compliant blanket, wherein said overcoat is sectioned into segments and said segments are separated by less than 20 μm; and transferring said multicolor toner images from said intermediate transfer member to a receiving sheet, in the presence of an electric field urging toner particles from said intermediate transfer member to said receiving sheet.

31. The method according to claim 30 wherein said segments are on average separated by less than 12 μm.

32. The method according to claim 30 wherein said segments are on average separated by less than 6 μm.

33. The method according to claim 30 further comprising the steps of:

removing excess toner particles from said intermediate transfer member after said toner image has been transfered to said receiver and while a top surface of said intermediate transfer member is flexed in a direction which urges said segments together.

* * * * *

UNITED STATES PATENT AND TRADEMARK OFFICE

CERTIFICATE OF CORRECTION

PATENT NO. : 5,714, 288

DATED : February 3, 1998

INVENTOR(S) : William B. Vreeland II, et al.

It is certified that error appears in the above-identified patent and that said Letters Patent is hereby corrected as shown below:

| | |
|---|---|
| Col. 10, line 28 | Delete "receiver" and insert --receiving sheet--. |
| Col. 10, line 45 | Delete "a" and insert --the--. |
| Col. 10, line 58 | Delete "receiver" and insert --receiving sheet--. |
| Col. 10, line 61 | Delete "toned" and insert --toner--. |
| Col. 11, line 36 | Delete "is formed." |
| Col. 12, line 23 | After "multicolor" insert --toner--. |
| Col. 12, line 28 | Delete "images" and insert --image--. |
| Col. 12, line 40 | After "said" insert --multicolor--. |
| Col. 12, line 41 | Delete "receiver" and insert --receiving sheet--. |

Signed and Sealed this

First Day of September, 1998

Bruce Lehman

*Attest:*

BRUCE LEHMAN

*Commissioner of Patents and Trademarks*

*Attesting Officer*

UNITED STATES PATENT AND TRADEMARK OFFICE

Certificate

Patent No. 5,714,288 Patented: February 3, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: William B. Vreeland, II, Webster; Thomas N. Tombs, Brockport; Donald S. Rimai, Webster; and David J. Quesnel, Pittsford, all of NY.

Signed and Sealed this Sixteenth Day of November, 1999.

NAM X. NGUYEN
*Supervisory Patent Examiner*
Art Unit 1753